US009695378B2

(12) United States Patent
Hayama et al.

(10) Patent No.: US 9,695,378 B2
(45) Date of Patent: Jul. 4, 2017

(54) SLIDING MECHANISM AND GREASE COMPOSITION FOR SLIDING MECHANISMS

(71) Applicant: NISSAN MOTOR CO., LTD., Yokohama-shi, Kanagawa (JP)

(72) Inventors: Makoto Hayama, Chigasaki (JP); Terasu Yoshinari, Chigasaki (JP); Masanori Komaba, Sendai (JP); Yutaka Mabuchi, Yokohama (JP); Yoshiteru Yasuda, Yokohama (JP); Saburo Abe, Ebina (JP); Katsuyuki Serizawa, Isehara (JP); Tsuyoshi Higuchi, Yokohama (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 14/389,901

(22) PCT Filed: Mar. 29, 2013

(86) PCT No.: PCT/JP2013/059552

§ 371 (c)(1),
(2) Date: Oct. 1, 2014

(87) PCT Pub. No.: WO2013/150975

PCT Pub. Date: Oct. 10, 2013

(65) Prior Publication Data

US 2015/0072906 A1 Mar. 12, 2015

(30) Foreign Application Priority Data

Apr. 2, 2012 (JP) ..... 2012-084108

(51) Int. Cl.

| | |
|---|---|
| ***C10M 171/02*** | (2006.01) |
| ***C10M 169/04*** | (2006.01) |
| ***C10M 117/02*** | (2006.01) |
| ***F16C 31/04*** | (2006.01) |
| ***C10N 40/02*** | (2006.01) |
| ***C10M 169/02*** | (2006.01) |

(52) U.S. Cl.

CPC .. *C10M 169/02* (2013.01); *C10M 2203/1006* (2013.01); *C10M 2205/0285* (2013.01); *C10M 2207/0406* (2013.01); *C10M 2207/1285* (2013.01); *C10M 2207/2825* (2013.01); *C10M 2209/1033* (2013.01); *C10N 2220/022* (2013.01); *C10N 2230/06* (2013.01); *C10N 2240/02* (2013.01); *C10N 2250/10* (2013.01); *C10N 2280/00* (2013.01)

(58) Field of Classification Search

CPC ..... C10M 2207/1285; C10M 2210/01; C10M 169/02; C10M 2205/0285; C10M 2207/2825; C10M 2209/1033; C10M 2203/1006; C10M 2207/0406; C10N 2280/00; C10N 2250/10; C10N 2240/02; C10N 2220/022; C10N 2230/06; C10N 2210/01

See application file for complete search history.

(56) References Cited

U.S. PATENT DOCUMENTS

| | | | | |
|---|---|---|---|---|
| 4,859,352 | A * | 8/1989 | Waynick | 508/174 |
| 5,714,444 | A | 2/1998 | Yokouchi et al. | |
| 7,228,786 | B2 * | 6/2007 | Hamada et al. | 92/155 |
| 7,771,821 | B2 | 8/2010 | Martin et al. | |
| 8,445,415 | B2 | 5/2013 | Mabuchi et al. | |
| 2005/0064196 | A1 | 3/2005 | Martin et al. | |
| 2007/0292711 | A1 * | 12/2007 | Ueno et al. | 428/688 |
| 2008/0194441 | A1 * | 8/2008 | Kawata et al. | 508/208 |
| 2011/0034357 | A1 * | 2/2011 | Kawata et al. | 508/202 |
| 2011/0136708 | A1 * | 6/2011 | Mabuchi et al. | 508/122 |

FOREIGN PATENT DOCUMENTS

| | | | |
|---|---|---|---|
| CN | 1833018 | A | 9/2006 |
| EP | 1479946 | A2 * | 11/2004 |
| EP | 1510594 | A2 | 3/2005 |
| EP | 2316912 | A1 | 5/2011 |
| JP | 8-143884 | A | 6/1996 |
| JP | 2002-363590 | A | 12/2002 |
| JP | 2003-181185 | A | 7/2003 |
| JP | 2006-194281 | A | 7/2006 |
| JP | 2010-053236 | A1 | 3/2010 |
| WO | WO 2006075219 | A2 * | 7/2006 |
| WO | WO 2010/001784 | A1 | 1/2010 |
| WO | WO 2010001784 | A1 * | 1/2010 |

OTHER PUBLICATIONS

Emery Synthetic Lubricant Basestocks Technical Data Sheet #2033A-7/2000.*

Extended Search Report issued in European Patent Application No. 13772304.5 dated Mar. 10, 2015.

* cited by examiner

*Primary Examiner* — Pamela H Weiss

(74) *Attorney, Agent, or Firm* — Foley & Lardner LLP

(57) ABSTRACT

A sliding mechanism includes first and second members slidable relative to each other and a grease composition interposed between the first and second members and containing a thickening agent and a base oil, wherein the grease composition contains lithium 12-hydroxystearate as the thickening agent and dioctyl sebacate and/or poly-α-olefin as the base oil; and wherein at least one of the first and second member has a sliding surface coated with a hard carbon film of diamond-like carbon.

5 Claims, No Drawings

SLIDING MECHANISM AND GREASE COMPOSITION FOR SLIDING MECHANISMS

FIELD OF THE INVENTION

The present invention relates to a sliding mechanism. More particularly, the present invention relates to a sliding mechanism in which sliding members are slidable via a hard carbon film in the presence of a specific grease and a grease composition therefor.

BACKGROUND ART

In automotive vehicles, sliding materials play a role in imparting high wear resistance and low friction coefficients to engine sliding parts under extreme friction/wear conditions. It has recently been attempted to apply various hard thin film materials and roller rocker arms with roller needle bearings to follower parts such as valve lifters and lifter shims.

Hard carbon materials, in particular diamond-like carbon (DLC) materials, are expected as low-friction sliding materials due to the fact that the hard carbon materials generally show low friction coefficients in the air in the absence of lubricating oils than those of wear-resistant hard coating materials such as titanium nitride (TiN) and chromium nitride (CrN).

Further, Patent Document 1 discloses a sliding mechanism that attains low-friction characteristics by the use of sliding members, at least one of which has a hard carbon coating formed of DLC with a hydrogen content of 20 atomic % or less, in combination with a grease containing an ester oil, an ether oil or a mixture thereof as a base oil.

There has however been a demand to achieve further friction reduction in terms of resource conservation and energy conservation. It is accordingly an object of the present invention to provide a sliding mechanism capable of showing a lower friction coefficient for friction reduction and, at the same time, improving in wear resistance and a grease composition for use in such a sliding mechanism.

PRIOR ART DOCUMENTS

Patent Document

Patent Document 1: Japanese Laid-Open Patent Publication No. 2006-194281

SUMMARY OF THE INVENTION

As a result of extensive research, the present inventors have newly found that the use of lithium 12-hydroxystearate (Li—(12OH)St) as a thickening agent makes it possible that not only ester and ether oils but also poly-α-olefin can effectively act to reduce frictions between sliding members in sliding mechanisms. The present inventors have also found that dioctyl sebacate, which is one kind of dibasic acid ester, has a particularly good friction reducing effect as compared to other ester oils. Namely, the present invention includes the following aspects.

1. A sliding mechanism, comprising:

first and second members slidable relative to each other; and a grease composition interposed between the first and second members and containing a thickening agent and a base oil, wherein the grease composition contains lithium 12-hydroxystearate as the thickening agent and dioctyl sebacate and/or poly-α-olefin as the base oil; and wherein at least one of the first and second member has a sliding surface coated with a hard carbon film of diamond-like carbon.

2. The sliding mechanism according to the above aspect 1, wherein the base oil has a kinematic viscosity of 10 to 70 $mm^2$/sec at 40° C.
3. The sliding mechanism according to the above aspect 1 or 2, wherein the hard carbon film of diamond-like carbon has a hydrogen content of 0.5 atomic % or less.
4. A grease composition for a sliding mechanism, the sliding mechanism comprising first and second members slidable relative to each other with the grease composition interposed therebetween, at least one of the first and second members having a sliding surface coated with a hard carbon film of diamond-like carbon, the grease composition comprising:

a thickening agent; and a base oil, wherein the grease composition contains lithium 12-hydroxystearate as the thickening agent and dioctyl sebacate and/or poly-α-olefin as the base oil.

5. The grease composition for the sliding mechanism according to the above aspect 4, wherein the base oil has a kinematic viscosity of 10 to 70 $mm^2$/sec at 40° C.

It is possible that the sliding mechanism and the grease composition therefor according to the present invention can achieve further friction reduction. It is also possible that the sliding mechanism and the grease composition therefor according to the present invention can achieve high wear resistance.

DESCRIPTION OF EMBODIMENTS

[Grease Composition]

(Thickening Agent)

The grease composition of the present invention contains Li—(12OH)St as a thickening agent. In the present invention, any other thickening agent may be contained within the range that does not impair the performance of the grease composition. Examples of the other thickening agent are: metal soap thickening agents such as metal soaps of Li, Na etc. and composite metal soaps of any combination selected from Li, Na, Ba, Ca etc.; and non-soap thickening agents such as Benton, silica gels and urea compounds. The urea compounds can be diurea compounds, triurea compounds, tetraurea compounds, polyurea compounds, urea-urethane compounds, diurethane compounds and mixtures thereof. It is however most preferable to use Li—(12OH)St solely as the thickening agent.

The amount of the thickening agent contained in the composition is preferably 2 to 40 mass %, more preferably 5 to 30 mass %, still more preferably 8 to 25 mass %. In the case of using the other thickening agent, the amount of Li—(12OH)St contained in the thickening agent is preferably 50 to 100 mass %, more preferably 70 to 100 mass %, based on the total mass of the thickening agent.

(Base Oil)

The grease composition of the present invention contains dioctyl sebacate, which is one kind of dibasic acid ester, and/or poly-α-olefin as a base oil. The use of such a base oil leads to reduction of friction coefficient and improvement of wear resistance.

If the kinetic viscosity of the base oil is too low, it is not possible to obtain adequate wear resistance due to oil film breakage. If the kinetic viscosity of the base oil is too high, it is difficult to feed the grease composition to the lubrication part due to flowability deterioration. For these reasons, the kinetic viscosity of the base oil is preferably 10 to 70 $mm^2/s$, more preferably 10 to 50 $mm^2/s$, at 40° C.

(Additives)

The grease composition of the present invention may contain, as additives, a rust inhibitor, a load-carrying additive, an antioxidant and the like as needed. The amount of these additives contained is generally 0.01 to 10 mass %.

The rust inhibitor can be either an inorganic rust inhibitor or an organic rust inhibitor. Examples of the inorganic rust inhibitor are inorganic metal salts such as sodium silicate, sodium nitrite, sodium molybdate, lithium carbonate and potassium carbonate. Examples of the organic rust inhibitor are: benzoates such as sodium benzoate lithium benzoate; sulfonates such as calcium sulfonate and zinc sulfonate; carboxylates such as zinc naphthenate and sodium sebacate; succinic acid; succinic acid derivatives such as succinic anhydride and succinic acid half ester; sorbitan esters such as sorbitan monooleate and sorbitan trioleate; and fatty acid amine salts.

The load-carrying additive can be a phosphorus-based load-carrying additive such as phosphoric ester, a sulfur-based load-carrying additive such as polysulfide or sulfurized grease, a phosphorus-sulfur-based load-carrying additive such as phosphorothioate, or other load-carrying additive such as thiocarbamate, thiophosphate or organophosphate. There can also be used a solid lubricant such as $MoS_2$, graphite, MCA (melamine cyanurate), PTFE (polytetrafluoroethylene) or the like as the load-carrying additive.

The antioxidant is known for prevention of grease oxidation degradation and can be a phenol-based antioxidant or an amine-based antioxidant. Examples of the phenol-based antioxidant are 2,6-di-tertiary-butyl-p-cresol (BHT), 2,2'-methylenebis(4-methyl-6-tertiary-butylphenol), 4,4'-butanylidynebis(3-methyl-6-tertiary-butylphenol), 2,6-di-tertiary-butylphenol, 2,4-dimethyl-6-tertiary-butylphenol, tertiary-butylhydroxyanisole (BHA), 4,4'-butanylidynebis (3-methyl-6-tertiary-butylphenol), 4,4'-methylenebis(2,3-di-tertiary-butylphenol) and 4,4'-thiobis(3-methyl-6-tertiary-buthylphenol). Examples of the amine-based antioxidant are N-n-butyl-p-aminophenol, 4,4'-tetramethyl-di-aminodiphenylmethane, α-naphthylamine, N-phenyl-α-naphthylamine and phenothiazine.

[Sliding Mechanism]

(Diamond-like Carbon)

The sliding mechanism of the present invention has first and second sliding members slidable relative to each other in the presence of the grease composition. At least one of these sliding members has a sliding portion coated with a hard carbon film of diamond-like carbon (DLC).

Herein, the hard carbon film refers to a thin film of amorphous carbon-containing DLC in which carbon atoms are bonded by both of diamond bond ($sp^3$ bond) and graphite bond ($sp^2$ bond).

Specific examples of the DLC are: a-C (amorphous carbon) consisting only of carbon; a-C:H (hydrogen amorphous carbon) containing hydrogen; and MeC containing in a part thereof as a metal atom such as titanium (Ti) or molybdenum (M). It is preferable in the present invention that the hydrogen content of the DLC is low. Preferably, the hard carbon film is formed of DLC with a hydrogen content of 0.5 atomic % or less. It is more preferable that the hard carbon film is formed of hydrogen-free a-C type (amorphous carbon type) DLC.

(Base Material)

There is no particular limitation on the base materials of the first and second sliding members in the sliding mechanism of the present invention. There can preferably be used iron-based alloy such as steel as the base material of the sliding member.

In the present invention, the sliding mechanism allows sliding between the sliding members with the grease composition being interposed between the sliding surface of one of the sliding members and the DLC hard carbon film on the sliding surface of the other of the sliding members or sliding between the sliding members with the grease composition being interposed between the DLC hard carbon films on the respective sliding surfaces of the sliding members. In such sliding, there is no particular limitation on the friction/sliding form. The sliding can be allowed in any of point contact form, line contact form or surface contact form in the sliding mechanism of the present invention.

It is feasible to apply the sliding mechanism of the present invention to various sliding mechanisms where grease lubrication is required under the conditions of relatively high temperature and high pressure. The sliding mechanism can suitably be applied to sliding mechanism for automotive vehicles although there is no particular limitation on the type of the machine or apparatus to which the sliding mechanism is applied.

As described above, it is possible according to the present invention to achieve reduction of friction coefficient and improvement of wear resistance by the use of the sliding members, at least one of which has its sliding portion coated with DLC, in combination with the grease composition containing Li—(12OH)St as the thickening agent and dioctyl sebacate and/or poly-α-olefin as the base oil. Although the present invention is not limited to any theory, it is considered that Li—(12OH)St acts favorably on the DLC film in the boundary lubrication and mixed lubrication regions so as to provide a low friction coefficient in the present invention. This effect becomes small when the kinetic viscosity of the base oil becomes high so that the oil film increases in thickness to cause relatively less participation of Li—(12OH)St in lubrication. Thus, the kinetic viscosity of the base oil is preferably 10 to 70 $mm^2/sec$ at 40° C. in order to secure good lubrication. The reason for showing good friction/wear performance by the combined use of the poly-α-olefin and Li—(12OH)St is assumed that, because the poly-α-olefin is nonpolar, it is easier for Li—(12OH)St to be adsorbed on the sliding surface to provide a low friction coefficient. In the case of using the polar oil such as ester oil, the additive may be less effective due to competitive adsorption. It is however assumed that the adsorptivity of the base oil is high in the case of dioctyl sebacate.

EXAMPLES

[Test Greases]

Grease compositions were prepared by adding given amounts of Li—(12OH)St to base oils as shown in TABLE 1, mixing and heating the resulting admixtures to thereby dissolve Li—(12OH)St, cooling the oil mixtures, and then, kneading the oil mixtures by a three-roll mill. The kinetic viscosity of the respective base oils was measured at 40° C. according to JIS K 2220 23. The thus-obtained grease compositions were subjected to SRV test.

[Test Method]

The wear resistance and friction coefficient test was performed as follows.

Test machine: SRV tester (reciprocating friction tester)

Test conditions:

Temperature: 80° C.

Frequency: 50 Hz

Load: 400 N (contact pressure: 0.3 GPa)

Amplitude: 3 mm

Time: 30 min

Material:

Plate: [DLC]

SUS2 (polished to Ra<0.01 μm by lapping)+DLC coating (thickness: 0.7 μm) A thin film of DLC was formed by PVD arc ion plating on an upper sliding surface of the plate. The thus-formed DLC thin film had a hydrogen content of 0.5 atomic % and a thickness of 0.7 μm.

[steel]

SUS2 (polished to Ra<0.01 μm by lapping)

24 mm diameter and 7.9 mm thickness

Roller: [steel]

SUS2

15 mm diameter×22 mm length

Evaluation:

Friction coefficients were evaluated when stabilized after 30 minutes from the initiation of the test.

TABLE 1

| | | Example | | Comparative Example | | | |
|---|---|---|---|---|---|---|---|
| | | 1 | 2 | 1 | 2 | 3 | 4 |
| Base oil | dioctyl sebacate | ○ | | | | | |
| | poly-α-olefin | | ○ | | | | |
| | pentaerythritol 2-ethylhexanoate (main constituent) | | | ○ | | | |
| | dialkyl diphenyl ether | | | | ○ | | |
| | polyoxyalkylene glycol | | | | | ○ | |
| | mineral oil | | | | | | ○ |
| | kinematic viscosity mm2/s (40° C.) | 11.6 | 48 | 30 | 100 | 120 | 100 |
| Thickening agent | Li—(12OH)St mass % | 10 | 20 | 10 | 10 | 10 | 10 |
| Friction coefficient | μ (DLC/steel) | 0.011 | 0.013 | 0.017 | 0.029 | 0.036 | 0.039 |
| | μ (steel/steel) | 0.091 | 0.052 | 0.078 | 0.041 | 0.039 | 0.070 |

In Examples 1-2, it was possible to obtain low friction coefficients by the use of Li—(12OH)St as the thickening agent and dioctyl sebacate, that is, dibasic acid ester, or poly-α-olefin as the base oil. Among the ester and ether oils, the use of the dibasic acid ester (dioctyl sebacate) led to a particularly low friction coefficient as can be seen from comparison to Comparative Examples 1-2.

It is difficult to compare differences between the friction coefficients close to the low limit of μ, but is worthy of note that the friction coefficients were further reduced as compared to those of conventional ones (Comparative Examples 1-2) and were made lower than or equal to 0.015. Further, the rate of reduction of the friction coefficients was high assuming that of Comparative Example as 100%.

The effect of use of the DLC coating was also verified because the friction coefficients were lower in the case of DLC-to-steel sliding than in the case of steel-to-steel sliding.

The invention claimed is:

1. A sliding mechanism, comprising:

first and second members slidable relative to each other; and a grease composition interposed between the first and second members and containing a thickening agent and a base oil;

wherein the grease composition contains lithium 12-hydroxystearate as the thickening agent;

wherein the base oil of the grease composition consists of poly-α-olefin;

wherein an amount of the thickening agent contained in the grease composition is 8 to 25 mass %;

wherein the base oil has a kinematic viscosity of 10 to 50 $mm^2/s$ at 40° C.;

wherein at least one of the first and second members has a sliding surface coated with a hard carbon film of diamond-like carbon;

wherein the diamond-like carbon has a hydrogen content of 0.5 atomic % or less; and wherein the sliding mechanism has a friction coefficient of 0.015 or lower as measured in a stabilized state after 30 minutes from initiation of a friction coefficient test, where the friction coefficient test is performed with a reciprocating friction tester under the conditions of a temperature of 80° C., a frequency of 50 Hz, a load of 400 N and an amplitude of 3 mm.

2. The sliding mechanism according to claim 1, further comprising at least one additive selected from the group consisting of a rust inhibitor, a load-carrying additive and an antioxidant.

3. The sliding mechanism according to claim 2, wherein the at least one additive is contained in the grease composition in an amount of 0.01 to 10 mass %.

4. The sliding mechanism according to claim 1, wherein each of the first and second members is comprised of an iron-based alloy as a base material.

5. The sliding mechanism according to claim 1, wherein the amount of the thickening agent contained in the grease composition is 20 mass %.

* * * * *